US005509842A

United States Patent [19]

Nosker

[11] Patent Number: 5,509,842

[45] Date of Patent: Apr. 23, 1996

[54] METHOD FOR PRE-STRESSING CRT TENSION MASK MATERIAL

[75] Inventor: Richard W. Nosker, Princeton, N.J.

[73] Assignee: RCA Thomson Licensing Corp., Princeton, N.J.

[21] Appl. No.: 494,660

[22] Filed: Jun. 26, 1995

[51] Int. Cl.[6] ..... H01J 9/14

[52] U.S. Cl. ..... 445/37; 445/47; 29/448

[58] Field of Search ..... 445/37, 47, 68; 29/448; 254/250

[56] References Cited

U.S. PATENT DOCUMENTS

| | | | |
|---|---|---|---|
| 3,638,063 | 1/1972 | Tachikawa | 313/348 |
| 4,756,702 | 7/1988 | Steiner | 445/30 |
| 4,887,988 | 12/1989 | Canevazzi et al. | 445/37 |
| 4,894,037 | 1/1990 | Fendley et al. | 445/37 |
| 5,045,010 | 9/1991 | Fairbanks | 445/30 |
| 5,111,107 | 5/1992 | Kume et al. | 445/47 |
| 5,127,866 | 7/1992 | Adler et al. | 445/68 |

FOREIGN PATENT DOCUMENTS

| | | | |
|---|---|---|---|
| 57-3341A | 1/1982 | Japan | 445/47 |

*Primary Examiner*—P. Austin Bradley
*Assistant Examiner*—Jeffrey T. Knapp
*Attorney, Agent, or Firm*—Joseph S. Tripoli; Dennis H. Irlbeck; Vincent J. Coughlin, Jr.

[57] ABSTRACT

The present invention relates to a method for pre-stressing the CRT tension mask 24 to induce creep. The method includes the steps of applying a suitable force to the mask material to induce stress therein, heating the mask material to an ultimate temperature, for a sufficient time, while under stress, to induce creep, and cooling the material.

10 Claims, 5 Drawing Sheets

METHOD FOR PRE-STRESSING CRT TENSION MASK MATERIAL

This invention relates to a method for preparing tension mask material for a cathode-ray tube (CRT) and, more particularly to a method for pre-stressing CRT tension mask material to induce creep, before the mask material is introduced into the CRT.

BACKGROUND OF THE INVENTION

A shadow mask or a tension mask is part of the CRT faceplate panel assembly and is located in proximity to a luminescent screen formed on the interior surface of the viewing faceplate. As is well known in the CRT art, the mask acts as a color selection electrode, or parallax barrier, which ensures that each of the three electron beams generated by an electron gun, located in a neck of the CRT, lands only on its assigned phosphor deposit. The conventionally curved shadow mask, which is not under tension, is usually supported within a frame that is secured within the faceplate panel. Typically, the conventional shadow mask has a thickness of about 0.15 mm (6 mils) and has a transmission, in the center portion thereof, of about 18 to 20 %. A uniaxial tension mask, having parallel grid elements that extend in only one dimension and are laterally spaced apart with the same lateral spacing as the conventional shadow mask, has an inherently higher transmission because of the absence of lateral connecting tie bars. One such mask is described in U.S. Pat. No. 3,638,063, issued on Jan. 25, 1972 to Tachikawa et al. That tension mask is disclosed to be formed of grid elements having a width of 0.5 mm (19.7 mils) and a thickness of 0.1 mm (3.9 mils). A problem with tension masks is that the grid wires permanently expand during the CRT manufacturing operation, for example during frit sealing of the faceplate to the funnel of the CRT envelope where the sealing temperature is about 435° C., or higher. To prevent sagging of the grid wires after such expansion, the conventional approach is to provide sufficient frame compliance to maintain the necessary tension on the grid wires even after the wires are elongated during the sealing operation. However, depending on the materials selected for the grid wires and the frame members, the grid wires can experience such elongation at frit sealing that it may be difficult to provide sufficient frame compliance to maintain the necessary tension on the grid wires during normal tube operation. Accordingly, it is desirable to pre-stress the grid wires to induce a time dependent permanent strain, or elongation, of the material caused by stress, hereinafter referred to as creep, before the tension mask is mounted into the faceplate panel of the CRT.

SUMMARY OF THE INVENTION

The present invention relates to a method for pre-stressing the CRT tension mask material to induce creep. The method includes the steps of applying a suitable force to the mask material to induce stress therein, heating the mask material to an ultimate temperature, for a sufficient time, while under stress, to induce creep, and cooling the material.

DETAILED DESCRIPTION OF THE PREFERRED EMBODIMENT

Figure 1:
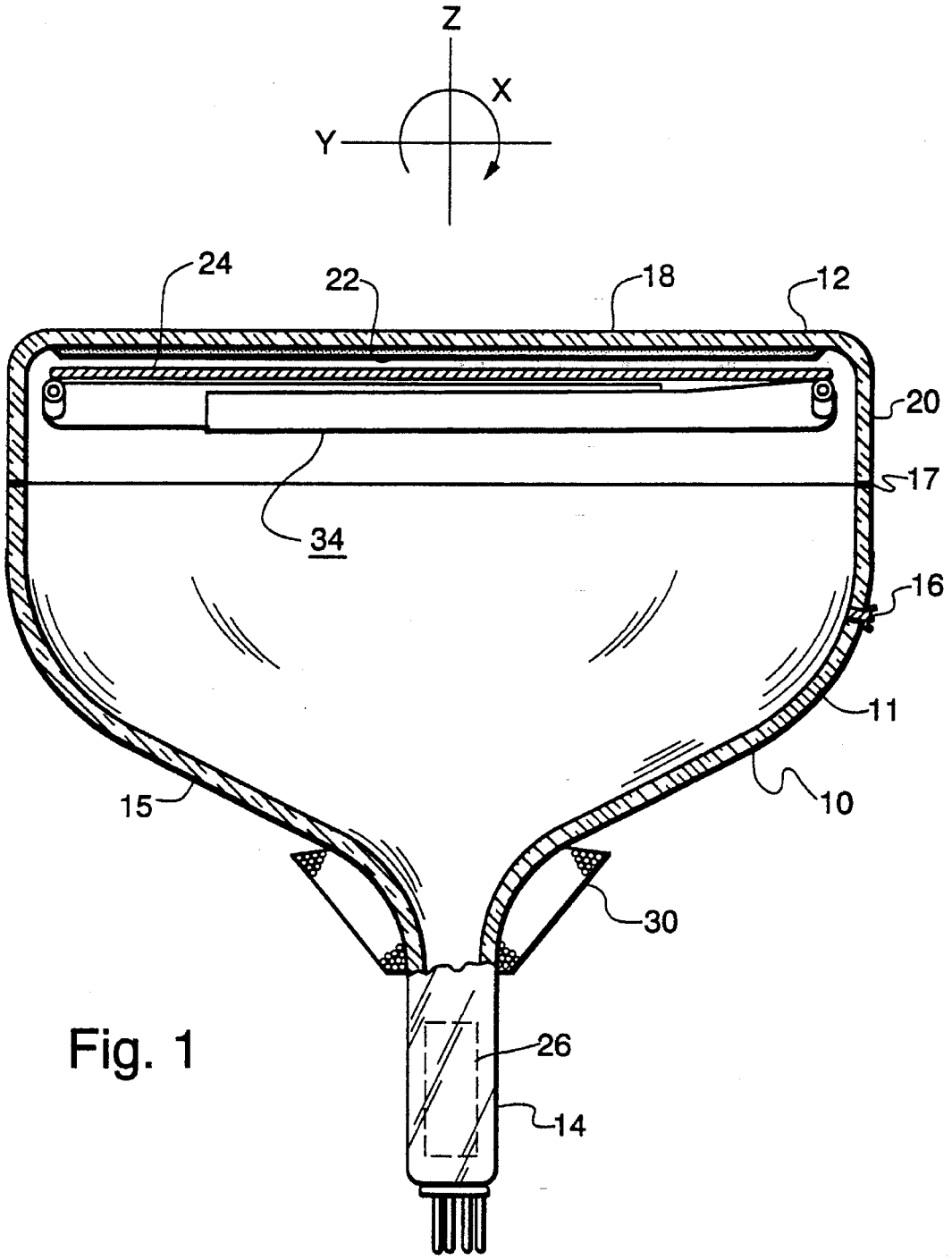
FIG. 1 is a plan view, partly in axial section, of a color CRT embodying the invention.

FIG. 1 shows a cathode-ray tube 10 having a glass envelope 11 comprising a rectangular faceplate panel 12 and a tubular neck 14 connected by a rectangular funnel 15. The funnel has an internal conductive coating (not shown) that extends from an anode button 16 to the neck 14. The panel 12 comprises a cylindrical viewing faceplate 18 and a peripheral flange or sidewall 20 that is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A cylindrical multi-apertured color selection electrode, or tension mask, 24 is removably mounted within the panel 12, in predetermined spaced relation to the screen 22. An electron gun 26, shown schematically by the dashed lines in FIG. 1, is centrally mounted within the neck 14 to generate and direct three inline electron beams, a center and two side or outer beams, along convergent paths through the mask 24 to the screen 22.

Figure 2:
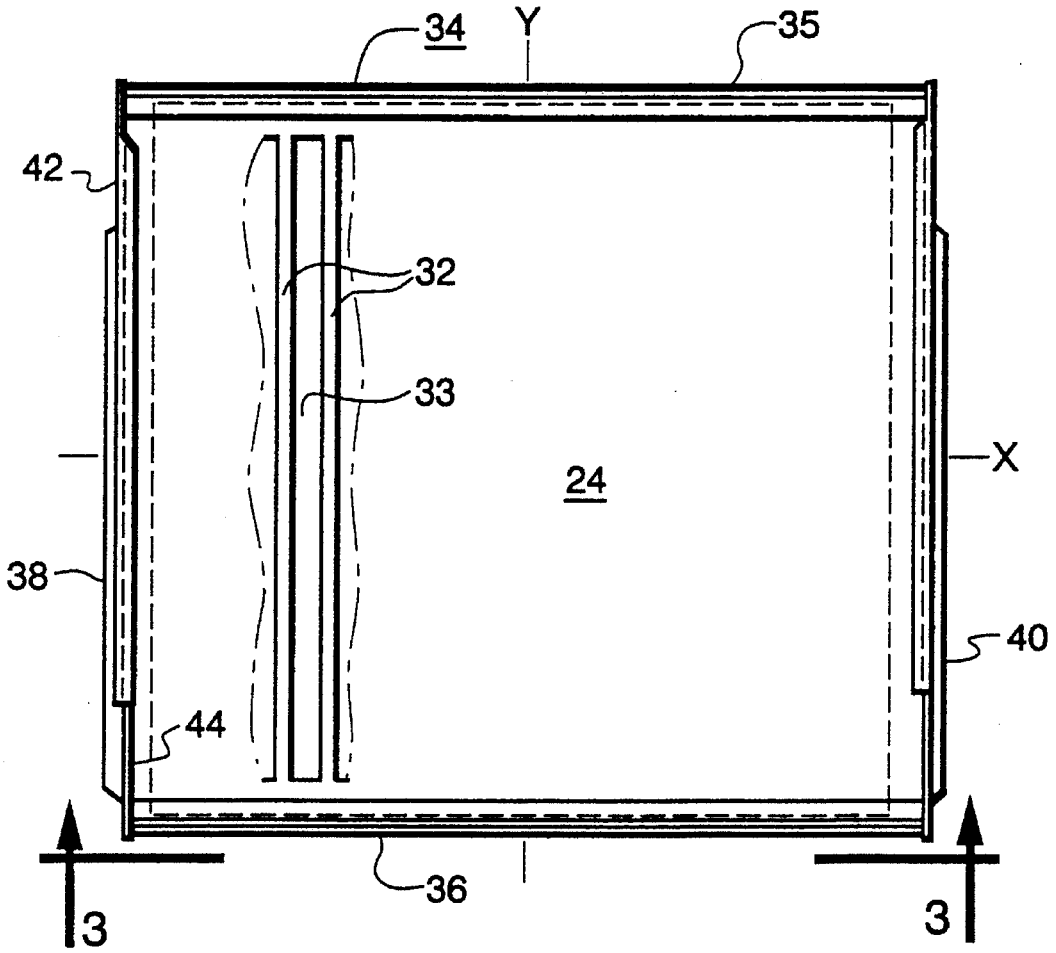
FIG. 2 is a plan view of a tensioned mask-frame assembly used in the CRT of FIG. 1.
Figure 3:
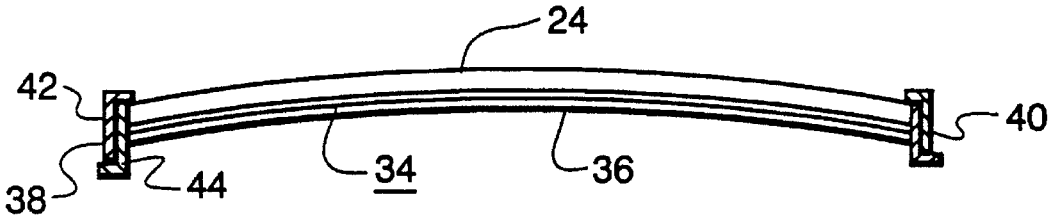
FIG. 3 is a front view of the mask-frame assembly taken along line 3—3 of FIG. 2.

The CRT of FIG. 1 is designed to be used with an external magnetic deflection yoke, such as the yoke 30, shown in the neighborhood of the funnel-to-neck junction. When activated, the yoke 30 subjects the three beams to magnetic fields that cause the beams to scan a horizontal and vertical rectangular raster over the screen 22. As shown in FIG. 2, the tension mask 24 is a uniaxial tension mask formed, preferably, from a thin rectangular sheet of about 0.05 mm (2 mil) thick low carbon steel, that includes two long sides and two short sides. The two long sides of the mask parallel the central major axis, X, of the mask and the two short sides parallel the central minor axis, Y, of the mask. The mask includes an apertured portion that contains a multiplicity of elongated strands 32 separated by slots 33 that parallel the minor axis of the mask. Each slot 33 extends from near one long side of the mask to near the other long side thereof. A frame 34, for the tension mask, is shown in FIGS. 1–3 and includes four major members, two torsion tubes or curved members 35 and 36 and two tension arms or straight members 38 and 40. The two curved members, 35 and 36, parallel the major axis X and each other. As shown in FIG. 3, each of the straight members 38 and 40 includes two overlapped partial members or parts 42 and 44, each part having an L-shaped cross-section. The overlapped parts 42 and 44 are welded together where they are overlapped. An end of each of the parts 42 and 44 is attached to an end of one of the curved members 35 and 36. The curvature of the curved members 35 and 36 matches the cylindrical curvature of the tension mask 24. The long sides of the uniaxial tension mask 24 are welded between the two curved members 35 and 36 which provide the necessary tension to the mask 24.

Figure 4:
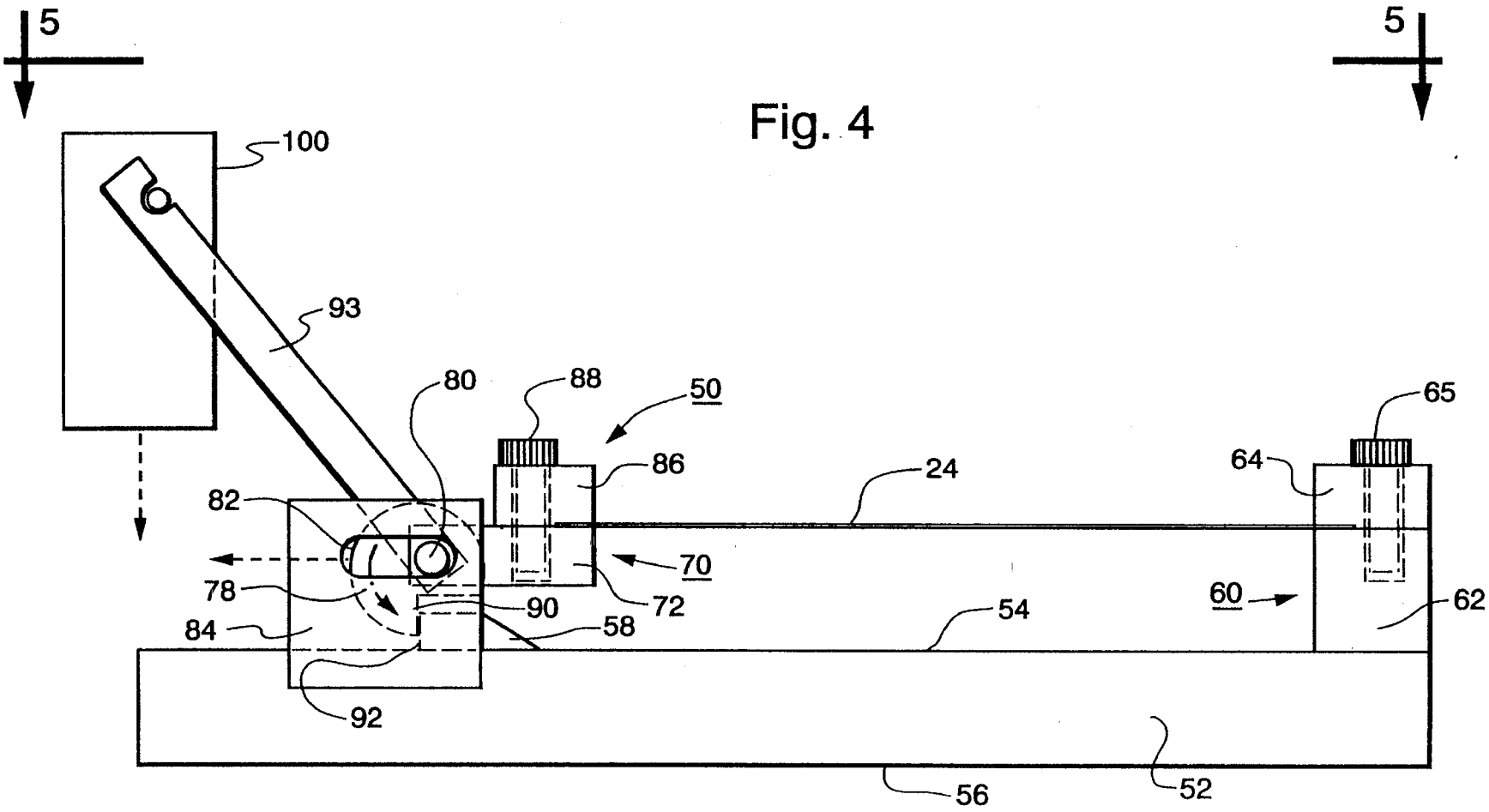
FIG. 4 is a side view of an apparatus for pre-stressing CRT tension mask material.
Figure 5:
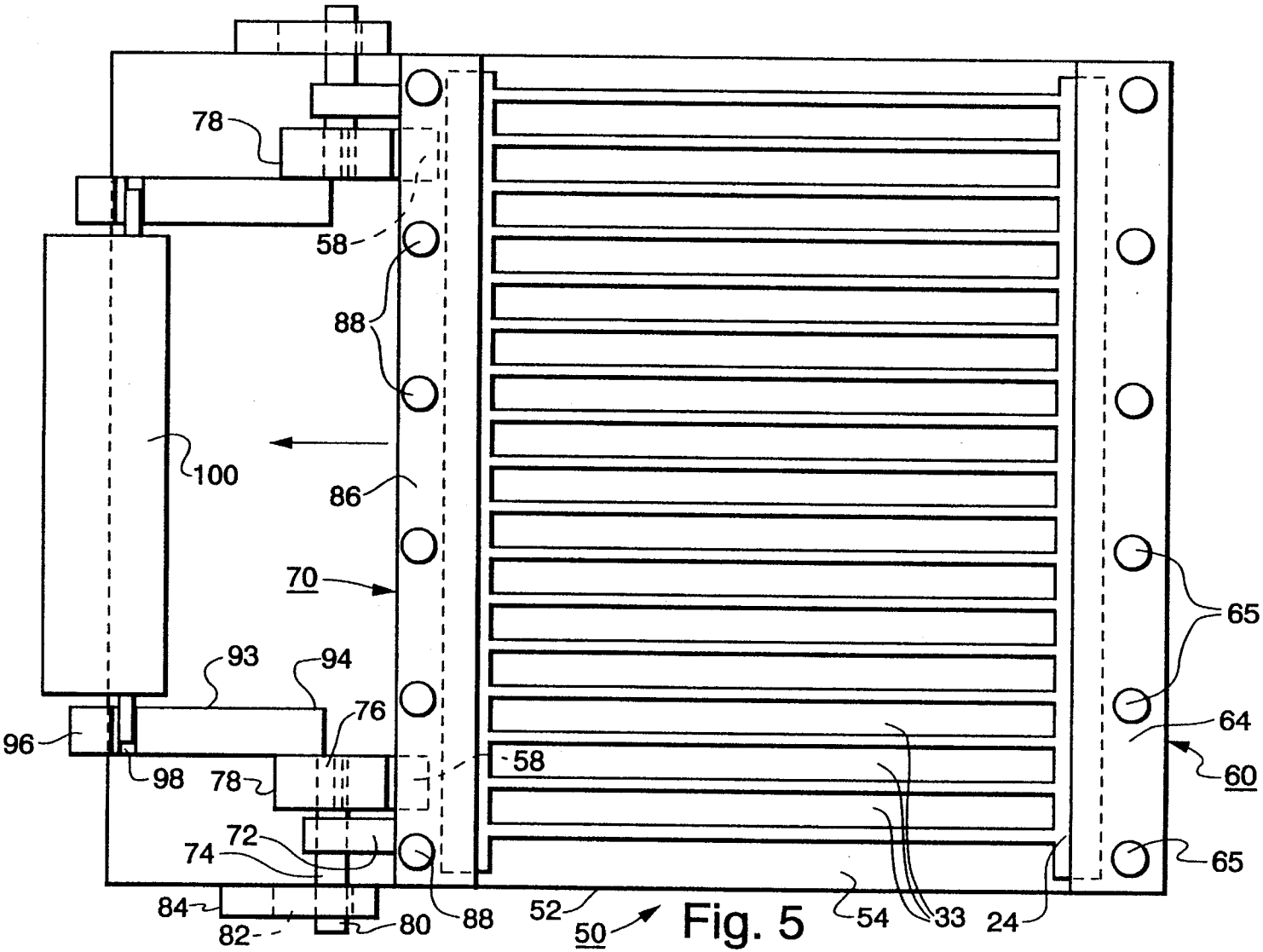
FIG. 5 is a top view of the apparatus taken along line 5—5 of FIG. 4.

In order to minimize additional creep of the tension mask during frit sealing of the faceplate panel 12 to the funnel 15, the uniaxial tension mask 24 is pre-stretched using the apparatus 50 shown in FIGS. 4 and 5. The apparatus 50 includes a support frame 52 having a first major surface 54 and an oppositely disposed second major surface 56. A boss 58 is provided on the first major surface 54 of the support frame 52 and projects above the surface, as described hereinafter. A primary clamp 60 having a first jaw 62 is spaced from the boss 58 and is either integral with or attached to the first major surface 54 of the frame 52 at one end thereof. The primary clamp 60 further includes an adjustable second jaw 64 that communicates with the first jaw 62 by means of primary attachment devices 65, such as screws or bolts, which can be adjusted to clamp the tension mask material between the first and second jaws 62 and 64, respectively. A movable secondary clamp 70 is located in proximity to the boss 58. The secondary clamp 70 includes a third jaw 72 that is attached to an axle 74. The axle 74 has a proximal end 76 disposed within a cam 78 and a distal end 80 that extends through an elongated aperture 82 formed in a support post 84 that is attached to the support frame 52. The aperture 82 is elongated in a plane parallel to the first major surface 54 of the support frame. The secondary clamp 70 further includes an adjustable fourth jaw 86 that communicates with the third jaw 72 by means of secondary attachment devices 88, such as screws or bolts, which also can be adjusted to clamp the tension mask material between the third and fourth jaws 72 and 86, respectively. The cam 78 has a boss engaging surface 90 that contacts a flat cam contacting surface 92 of the boss 58. A lever arm 93 has a proximal end 94 attached to the one side of the cam 78, for example by welding. The distal end 96 of the lever arm 93 includes a notch 98 that supports a weight 100 that applies a uniaxial stress to the shadow mask material. As shown in FIG. 5, the apparatus 50 is designed to uniformly pre-stress the tension mask 24 after the slots 33 are formed therethrough, preferably by etching. Alternatively, a section of tension mask material can be stressed before the slots 33 are formed therein, or a similar apparatus may be utilized to prestress individual metal strands, if the mask is formed by winding the strands on a mandrel, rather than by etching a sheet of mask material. Again with reference to FIG. 5, the cam 78 may comprise two separate cams located near each side of the first surface 54, in which case separate bosses 58 are located in proximity to each cam. The cam 78 provides an 11.5:1 pull ratio on the mask material. The amount of stress applied to the material is determined by the mass of the weight 100 that is utilized.

A 381 mm (15 in) long strand of tension mask material, having a width of 0.3 mm (12 mils) and a thickness of 0.05 mm (2 mils), made without the pre-stressing method of the present invention described herein, and heated to a temperature of 440° C. for 1 hour, experienced a creep of 0.43 mm (17 mils) when a stress of 703 kg $cm^{-2}$ ($10^4$ psi) was applied thereto. The amount of creep increased to 1.4 mm (55 mils) when the stress was increased to 1406 kg $cm^{-2}$ ($2\times 10^4$ psi). However, a strand of the same shadow mask material pre-stressed at 1406 kg $cm^{-2}$ for 1 hour at a temperature of 470° C., and then subjected to a stress of 703 kg $cm^{-2}$ at a temperature of 440° C. for 1 hour, the latter approximating frit sealing conditions, experienced no additional creep. But, if the stress were increased to 1406 kg $cm^{-2}$ at a temperature of 440° C. for 1 hour, the amount of creep increased to 0.43 mm (17 mils).

Figure 6:
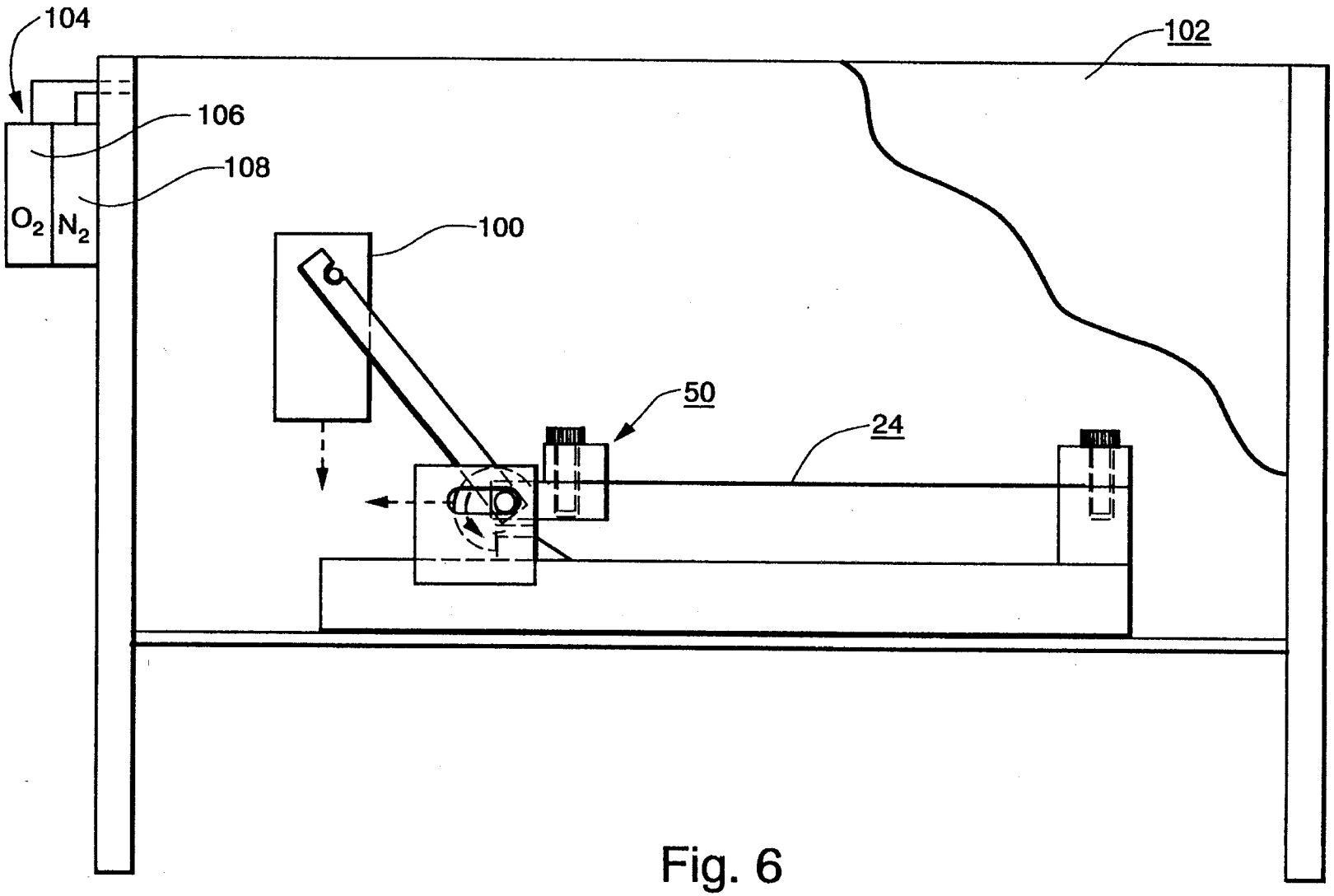
FIG. 6 is a side view of the apparatus of FIG. 4 within a furnace having a controlled atmosphere.

In order to further reduce creep during frit sealing, the preferred pre-stressing method is performed at a temperature substantially in excess of the frit sealing temperature. In the preferred method, a tension mask 24 is positioned between the primary clamp 60 and the movable secondary clamp 70 and secured therebetween by attachment devices 65 and 88. A stress of about 1547 kg $cm^{-2}$ ($2.2\times10^4$ psi) is induced into the clamped tension mask 24 by applying a 12.3 kg (27.1 lb) weight to the distal end 96 of the lever arm 93. The apparatus 50 is then loaded into a furnace 102, shown in FIG. 6, which includes a suitable gas mixer 104 that provides a slightly oxidizing atmosphere of mostly nitrogen and a few percent oxygen within the furnace. Typically, the nitrogen comprises about 96 wt. % of the furnace atmosphere and the oxygen about 4 wt. %. Flow regulators 106 and 108 control the amount of oxygen and nitrogen, respectively. The temperature of the furnace 102 is increased to 500° C. at a rate of about 10° C./min., and held at that temperature for about 1 hour. The mask material is then cooled to room temperature (about 22° C.). The 500° C. temperature, which is substantially in excess of the frit sealing temperature of about 460° C., permits the 381 mm long strands of the mask material to creep an average of about 2.515 mm (99 mils). The slightly oxidizing atmosphere utilized during the pre-stressing of the mask material, also blackens the mask during the pre-stressing process to decrease reflections therefrom, thereby improving the contrast of the CRT screen.

The preferred mild steel used to form the tension mask 24 has a composition, by weight, of about 0.005% carbon, 0.01% silicon, 0.12% phosphorus, 0.43% manganese, and 0.007% sulfur. Preferably, the ASTM grain size is within the range of 9 to 10. Pre-stressing of the mask material according to the preferred method of the present invention overloads the tension mask so that the activated material within the mask diffuses into the grain boundaries thereof, under the applied stress. This makes the material less likely to creep further during frit sealing. Tension masks processed as described herein, experienced additional creep of only an additional 0.05 mm (2 mil) when held at a tensile stress of 1406 kg/$cm^{-2}$ ($2\times 10^4$ psi) for 1 hour at a frit sealing temperature of 460° C. Even when the mask material, pre-stressed as described herein, was subjected to a long frit cycle in which the temperature was slowly increased over 7 hours to 460° C. and held at that temperature for one hour, the creep was only an additional 0.05 mm (2 mil). This small amount of additional elongation can be compensated for by the compliance of the mask frame and poses no problem for masks processed by the novel method.

What is claimed is:

1. A method for pre-stressing CRT tension mask material to induce creep, including the steps of a) applying a suitable force to said mask material to induce stress therein, b) heating said mask material to an ultimate temperature and for a sufficient time, while under stress, to induce creep, and c) cooling said mask material.

2. The method as described in claim 1, further including performing heating step b) in a slightly oxidizing atmosphere to form an oxide layer on the surface of said mask material.

3. The method as described in claim 1, wherein said force induces a stress of about 1547 kg $cm^{-2}$.

4. The method as described in claim 1, wherein said elevated temperature is about 500° C.

5. The method as described in claim 1, wherein said sufficient time is about 1 hour.

6. A method for pre-stressing a uniaxial tension mask, for use in a CRT, to induce creep at an elevated temperature, including the steps of a) applying a force to a mask, in said uniaxial direction, to induce stress in said uniaxial direction, b) heating said mask to a said elevated temperature, in excess of any processing temperature to which said CRT will be exposed during the manufacturing thereof, for a sufficient time, while under stress, to induce creep, and c) cooling said mask to room temperature.

7. The method as described in claim 6, further including performing heating step b) in a slightly oxidizing atmosphere to form an oxide layer on the surface of said mask.

8. The method as described in claim 6, wherein said force induces a stress of about 1547 kg $cm^{-2}$.

9. The method as described in claim 8, wherein said elevated temperature is about 500° C.

10. The method as described in claim 9, wherein said sufficient time is about 1 hour.

* * * * *